US005106701A

United States Patent [19]

Kurosaka et al.

[11] Patent Number: 5,106,701

[45] Date of Patent: Apr. 21, 1992

[54] COPPER ALLOY WIRE, AND INSULATED ELECTRIC WIRES AND MULTIPLE CORE PARALLEL BONDED WIRES MADE OF THE SAME

[75] Inventors: Akihito Kurosaka; Sueji Chabata, both of Tokyo; Haruo Tominaga; Kenichi Miyauchi, both of Sakura; Michio Koike, Naka; Takashi Nishida, Numazu; Hirohito Takemura, Numazu; Toshihito Watanabe, Numazu; Kazumichi Kasai; Takao Tsuboi, both of Shizuoka, all of Japan

[73] Assignee: Fujikura Ltd., Tokyo, Japan

[21] Appl. No.: 645,819

[22] Filed: Jan. 25, 1991

[30] Foreign Application Priority Data

Feb. 1, 1990 [JP] Japan ..... 2-22818
Nov. 30, 1990 [JP] Japan ..... 2-334098

[51] Int. Cl.[5] ..... C22C 9/00; C22F 1/08; H01B 1/02

[52] U.S. Cl. ..... 428/606; 148/11.5 C; 148/432; 174/110 SR; 174/117 F

[58] Field of Search ..... 428/606; 420/497; 148/11.5 C, 432; 174/110 R, 110 SR, 117 F, 117 R

[56] References Cited

U.S. PATENT DOCUMENTS

| | | | |
|---|---|---|---|
| 2,559,031 | 7/1951 | Sykes | 420/497 |
| 4,059,437 | 11/1977 | Nesslage et al. | 146/432 |
| 4,726,559 | 2/1988 | Hosoda et al. | 148/165 C |
| 4,734,254 | 3/1988 | Nippert | 420/497 |

FOREIGN PATENT DOCUMENTS

| | | | |
|---|---|---|---|
| 29888 | 6/1981 | European Pat. Off. . | |
| 975448 | 11/1961 | Fed. Rep. of Germany . | |
| 45-21183 | 7/1970 | Japan | 420/497 |
| 56-44759 | 4/1981 | Japan | 148/11.56 |
| 57-70244 | 4/1982 | Japan | 420/497 |
| 567603 | 2/1945 | United Kingdom | 420/497 |

OTHER PUBLICATIONS

W. Hodge et al., "New Copper-Base Alloys Combine High Strength with High Conductivity", Materials & Methods, Jan. 1950, pp. 64–65.

Patent Office of Japan File suppliers JAPS & JPA62118737 (Toshiba) *abstract*.

Patent Office of Japan File Suppliers JAPS & JPA1313121 (Showa Electric) *abstract*.

S. Takahashi et al., "New High Performance Parallel Bonded Fine Enamalled Wire for Hard Disk Drive Head", 1989 IEEE, pp. 173–179.

*Primary Examiner*—John Zimmerman

*Attorney, Agent, or Firm*—Oblon, Spivak, McClelland, Maier & Neustadt

[57] ABSTRACT

A copper alloy wire has a composition composed of no less than 0.01% by weight of Ag and balance Cu and unavoidable impurities. The copper alloy wire has been prepared by drawing a wire stock having the composition at a reduction ratio of no lower than 40% and subjecting the wire stock to heat treatment for half annealing to have a tensile strength of no lower than 27 kg·f/mm$^2$ and an elongateion of 5%. An insulated electric wire includes the copper alloy wire as a conductor and an insulation layer covering the wire. Also, a multiple core parallel bonded wire includes two or more such insulated electric wires bonded parallel to each other.

8 Claims, 2 Drawing Sheets

COPPER ALLOY WIRE, AND INSULATED ELECTRIC WIRES AND MULTIPLE CORE PARALLEL BONDED WIRES MADE OF THE SAME

BACKGROUND OF THE INVENTION

1. Field of the Invention

The present invention relates to a copper alloy wire suitable for a conductor for use in wirings for magnetic heads, and insulated electric wires and multiple core parallel bonded wires including the copper alloy wire as a conductor. More particularly, the present invention relates to those which are suitable for use as fine wires having excellent electroconductivity, tensile strength and elongation and having a wire diameter of no larger than 90 μm.

2. Prior Art

Recently, there has been rapidly increased a demand for fine copper wires having a wire diameter of no larger than 0.1 mm, particularly those having a wire diameter of no larger than 50 μm in the field of copper wires and core wires for magnetic head windings along with the development of electronic devices.

Along with the fining of copper wires, however, there have arisen some problems that upon winding of wires breakage of the wires tends to occur and the terminals of the wires tend to be bent. For example, when a copper fine wire is wound around the ferrite core portion of a magnetic head through its window portion, it will be difficult to pass the wire through the window portion if the terminals of the wire are bent. If this did actually occur, emergency measures could be taken in the case where winding was carried out by manual operation. However, in automatic winding steps using robots whose introduction has recently been accelerated for labor-saving, the occurrence of such breakage or bending of wires unavoidably leads to reduction in productivity. Therefore, copper fine wires used as a core wire of a magnetic head winding are required to have increased tensile strength, elongation, as well as improved bending resistance without decreasing in electroconductivity.

However, when copper fine wires are formed by a drawing method comprising drawing a copper wire stock to a high reduction ratio which is a method generally used for increasing the tensile strength of copper wires, the elongation of wire decreases so that desired elongation cannot be obtained and electroconductivity of the resulting fine wire is deteriorated. On the other hand, when the copper fine wire obtained by reduction is annealed to fully soften in order to increase elongation, there arises a problem that no desired tensile strength and bending resistance can be obtained.

SUMMARY OF THE INVENTION

Under the circumstances, it is an object of the present invention to provide a copper alloy wire which has an improved bending resistance without decreasing of electroconductivity and can prevent breakage and bending of the wire upon winding.

Another object of the present invention is to provide insulated electric wires made from such improved copper alloy wire.

Still another object of the present invention is to provide multiple core parallel bonded wires made from such improved copper alloy wire.

As a result of extensive investigations, the present invention has been completed and provides a copper alloy wire having a composition composed of no less than 0.01% by weight of Ag and balance Cu and unavoidable impurities, wherein said copper alloy wire has been prepared by drawing a wire stock having said composition at a reduction ratio of no lower than 40% and subjecting said wire stock to heat treatment for half annealing to have a tensile strength of no lower than 27 kg·f/mm$^2$ and an elongation of 5%.

Also, the present invention provides an insulated electric wire comprising the above copper alloy wire as a conductor and an insulation layer covering the conductor.

Furthermore, the present invention provides a multiple core parallel bonded wire comprising two or more of the above insulated electric wire parallel bonded to each other as cores.

DETAILED DESCRIPTION OF THE INVENTION

Figure 1:
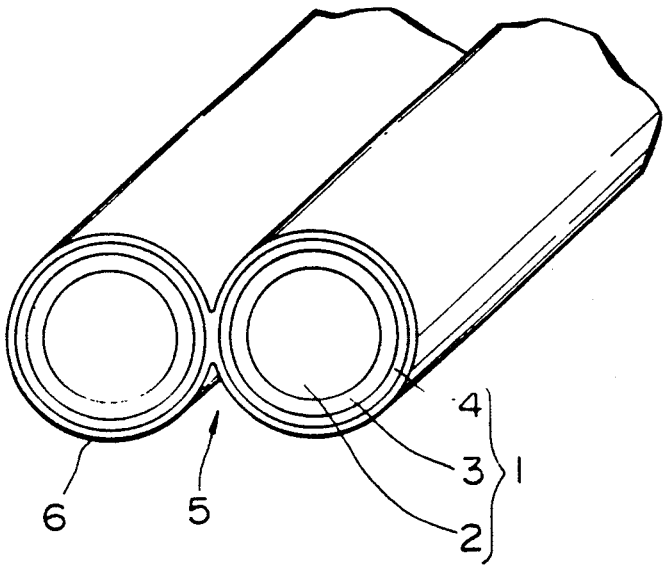
FIG. 1 is a diagrammatical perspective view of the multiple core parallel bonded wire of the present invention.

The copper alloy wire of the present invention is made of a copper alloy which comprises 0.01% by weight of Ag and balance Cu and unavoidable impurities. The content of Ag is preferably in the range of 0.02 to 0.5% by weight. The Cu may be tough pitch copper which is usually used but it is preferred to use oxygen free copper (OFC), if possible. The oxygen free copper is preferably of a purity of no lower than 99.99%.

If the Ag content is less than 0.01% by weight, the Ag content is insufficient and the softening temperature (recrystallization temperature) cannot be elevated sufficiently, resulting in that the resulting copper alloy wire tends to be fully softened in an enameling step or the like. For this reason, the Ag content in the wire stock is set up to no less than 0.01% by weight. On the contrary, the Ag content exceeding 0.5% by weight is inconvenient because not only the resistance of the conductor increases but also cost becomes higher. The oxygen content of the oxygen free copper is set up to no more than 30 ppm. If it exceeds 30 ppm, the amount of non metal contaminants composed of oxides increases, resulting in that there tends to occur breakage of the wire upon drawing. The oxygen free copper to be used in the present invention may contain some unavoidable impurities but it is preferred that total amount of the unavoidable impurities be no more than 0.009 by weight.

Wires are cast from the copper alloy having the above-described composition by a conventional casting method, and then the resulting wires are processed by a conventional drawing method at a reduction ratio of no lower than 40% to obtain multiple fine wires having a desired outer diameter, e.g., 50 μm. The drawing can be carried out dividedly in several steps. For example, wires having a diameter of 16 to 20 mm are cast and drawn to wires having a diameter of 1 to 2 mm. Then, the wires are annealed in an inert gas atmosphere to full anneal them (full softening treatment), followed by drawing them at a reduction ratio of no lower than 40%, preferably no lower than 90%, and more preferably no lower than 99.9%, to obtain fine wires having an objective outer diameter, for example, 50 μm. By the term "reduction ratio of no lower than 40%" referred to herein is meant that the reduction ratio of the wire after the final drawing step in order to obtain the objective outer diameter of the wire is no lower than 40%. Therefore, while it is possible to carry out annealing properly in a series of drawing steps, the reduction ratio of the wire in the final drawing must be no lower than 40%.

If the reduction ratio as defined above is lower than 40%, the resulting copper alloy wire cannot have a desired tensile strength after production.

Next, the wire stock which has been subjected to the drawing at a reduction ratio of no lower than 40% as described above is then subjected to heat treatment for half annealing. By the term "heat treatment for half annealing" herein is meant a heat treatment which is carried out on a generally cold-worked metal to a degree such that recrystallization proceeds halfway.

Therefore, specific conditions under which the heat treatment for half annealing is carried out include temperature and time which can be set up in very wide ranges, respectively. Principally, it is sufficient to select temperature and time conditions which meet activation energy for recrystallization.

In the present invention, the conditions, i.e., temperature and time of heat treatment for half annealing are set up so that the wire after the heat treatment for half annealing has a tensile strength of no lower than 27 kg·f/mm$^2$, preferably 27 to 35 f/mm$^2$ and an elongation of no lower than 5%, preferably 5 to 15%. It is preferred to carry out the heat treatment for half annealing in a non-oxidative atmosphere such as an inert gas atmosphere.

If the copper alloy wire has a tensile strength of lower than 27 kg·f/mm$^2$, a desired bending strength cannot be obtained in the winding step and breakage of the wire tends to occur. On the other hand, if the wire has an elongation of lower than 5%, the wound, coil-shaped wire tends to be bent back to cause so-called spring back, thus making it difficult to carry out winding. Therefore, it is necessary to carry out heat treatment for half annealing so that there can be obtained sufficient mechanical characteristics such as a tensile strength of no lower than 27 kg·f/mm$^2$ and an elongation of no lower than 5%.

In the present invention, it is preferred to prepare fine wires having a diameter of no larger than 90 μm, preferably no larger than 50 μm from the thus-obtained wire.

The copper alloy wire thus obtained has a tensile strength more than is necessary and a proper elongation, and its mechanical characteristics such as tensile strength and elongation in the subsequent enameling step are not deteriorated to below values desired for cores of winding.

Therefore, the wire causes no breakage in the step of winding and has an excellent bending resistance, resulting in that the terminals of the copper alloy wire are not bent, for example, when it is passed through the window portion of a magnetic head in the step of winding it around the ferrite core portion of the magnetic head.

Accordingly, according to the present invention, the mechanical characteristics, such as bending resistance, tensile strength and elongation, of the wire can be improved without deteriorating its electroconductivity so that breakage and bending of the copper alloy wire in the step of winding can be prevented.

Next, explanation will be made on the insulated electric wire of the present invention.

The insulated electric wire of the invention comprises the above-described copper alloy wire as a conductor and an insulation layer covered on the conductor. The insulation layer can be formed by coating and baking an insulation coating material such as polyester, polyurethane, polyesterimide, polyamideimide, polyamide, polyhydantoin, polyimide, polyvinylformal, polyvinylbutyral, epoxy resins and silicone resins by conventional methods. Among the coating materials, most preferred is polyurethane in view of solderability. The thickness of the insulation layer is not limited particularly but is preferably small for the purpose of the present invention. Usually, the thickness of the insulation layer is no larger than 10 μm, preferably 5 μm.

In addition, a protective layer may be provided on the insulation layer, if desired.

The protective layer, which is provided in order to prevent mechanical damages and the like of the insulation layer, can be formed by coating and baking an insulation coating material such as polyester, polyurethane, polyesterimide, polyamideimide, polyamide, polyhydantoin, polyimide, polyvinylformal, polyvinylbutyral, epoxy resins and silicone resins. Instead of the protective layer, a self-lubricating layer made of polyamide or the like or a self-bonding layer made of polyvinylbutyral, polyamide or the like may be provided on the insulation layer.

It is preferred that the insulated electric wire of the present invention be an fine electric wire also having a small outer diameter of no larger than 90 μm.

Now, referring to the accompanying drawings, explanation will be made on the multiple core parallel bonded wire of the present invention.

FIG. 1 illustrates a multiple core parallel bonded wire according to one embodiment of the present invention. In FIG. 1, reference numeral 1 designates an insulated wire. The insulated wire 1 includes a conductor 2 on which an insulation layer 3 is covered, and a protective layer 4 is further covered on the insulation layer 3.

The conductor 2 is made of the above-described copper alloy wire, whose diameter is not limited particularly. However, for the purpose of the present invention, it is desirable that the diameter is no larger than 50 μm as described above, preferably no larger than 40 μm.

On the conductor 2 is provided an insulation layer 3. The insulation layer can be formed by coating and baking an insulation coating material such as polyester, polyurethane, polyesterimide, polyamideimide, polyamide, polyhydantoin, polyimide, polyvinylformal, polyvinylbutyral, epoxy resins and silicone resins by conventional methods. Among these coating materials, most preferred is polyurethane in view of solderability. The thickness of the insulation layer 3 is not limited particularly but is preferably small for the purpose of the present invention. Usually, the thickness of the insulation layer 3 is no larger than 10 μm, preferably 5 μm.

Furthermore, on the insulated layer 3 is provided a protective layer 4 to form the insulated wire 1.

The protection layer 4 is to prevent mechanical damages or the like of the insulation layer 3 and thus is not always indispensable. The protection layer 4 can be formed by coating and baking an insulation coating material such as polyester, polyurethane, polyesterimide, polyamideimide, polyamide, polyhydantoin, polyimide, polyvinylformal, polyvinylbutyral, epoxy resins and silicone resins by conventional methods. Among these coating materials, most preferred is polyurethane in view of solderability. Instead of the protection layer 4, a self-lubricating layer made of nylon or the like or a self-bonding layer made of polyvinylbutyral or the like may be provided on the insulation layer 3.

Two pieces of the above-described insulated wire 1 are arranged and bonded parallel to each other with an adhesive resin composition to form a double core parallel bonded wire 5. In FIG. 1, reference numeral 6 designates an adhesive layer 6 composed of the adhesive resin composition. As the adhesive resin composition, there can be cited, for example, polyamide, polyvinylbutyral, polysulfone, polysulfone ether, epoxy resins, phenoxy resins and the like, and thermosetting resins composed of one or more of the above-described resins and a curing agent such as an isocyanate compound, an aminoplast compound or an acid anhydride. The thickness of the adhesive layer 6 is on the order of 1 to 10 μm. Of course, the thinner the more preferred.

Double core parallel bonded wire 5 can also be obtained without using the above-described adhesive resin composition. That is, the protective layer 4 or the insulation layer 3 itself can be used simultaneously as an adhesive resin composition. This can be realized by properly selecting the resin composition which constitutes the protective layer 4 or the insulation layer 3 and properly setting up the thickness thereof.

In the present invention, the parallel bonded wire may be those which can be obtained by bonding two pieces of the insulated wire 1 to each other along their longitudinal direction with interruptions or intermittently. In other words, bonded portions and non-bonded portions may appear alternately in the longitudinal direction of the double core parallel bonded wire.

Furthermore, three or more pieces of the insulated wire 1 can be arranged parallel to each other and bonded to form a multiple core parallel bonded wire.

The multiple core parallel bonded wire thus obtained has a high tensile strength despite its conductor diameter being small and therefore it will not break upon automatic winding or upon assembling after separation of the wire stock. In addition, despite the conductor diameter being small, the resistance of the conductor does not increase, resulting in that there is no increase in the direct current resistance even when the number of winding increases. Furthermore, the use of oxygen free copper gives rise to good high frequency characteristics, permitting transmission of signals up to 10 MHz at a low transmission loss.

Hereafter, the invention will be explained in greater detail by concrete examples.

TEST EXAMPLES 1 TO 6

Silver (Ag) was added to oxygen free copper containing 8 ppm of oxygen and 0.006% by weight of unavoidable impurities in various proportions and the resulting copper alloys were manufactured by a dip forming method to obtain wires having an outer diameter of 16 mm. Then the wires were drawn at a reduction ratio of no lower than 99.9% to obtain fine wires of a diameter of 40 μm using a continuous drawing machine. The fine wires were subjected to heat treatment for half annealing in an annealing furnace at 400° C. to obtain conductors.

These conductors were measured on their conductivity.

The results obtained are shown in Table 1 below.

TABLE 1

(Test Examples 1 to 6)

| Run No. | Amount of Ag (wt. %) | Diameter of Conductor (μm) | Conductivity (%, IACS) |
|---|---|---|---|
| 1 | 0.005 | 40 | 100 |
| 2 | 0.01 | 40 | 100 |
| 3 | 0.1 | 40 | 100 |
| 4 | 0.2 | 40 | 99 |
| 5 | 0.5 | 40 | 98 |
| 6 | 0.6 | 40 | 97 |

The results in Table 1 revealed that when the content of silver was not larger than 0.5% by weight, the conductivity becomes practically 100% of IACS.

TEST EXAMPLES 7 TO 9

Silver (0.1% by weight) was added to oxygen free copper containing 8 ppm of oxygen and 0.006% by weight of unavoidable impurities, and the resulting copper alloy was drawn by a dip forming method to obtain a wire having a diameter of 2.6 mm. Then the wire was drawn to obtain a wire having a diameter of 50 to 1270 μm, which was then fully annealed in an annealing furnace at 600° C.

The resulting wire was drawn at various reduction ratios to obtain fine wires having a diameter of 40 μm.

These conductors were measured on their, tensile strength and elongation.

The results obtained are shown in Table 2 below.

TABLE 2

(Test Examples 7 to 9)

| Run No. | Ratio (%) | Diameter of Conductor (μm) | Tensile Strength (kg.f/mm$^2$) | Elongation (%) |
|---|---|---|---|---|
| 7 | 99.9 | 40 | 50.0 | 0.2 |
| 8 | 42 | 40 | 27.5 | 11 |
| 9 | 37 | 40 | 26.4 | 15 |

As will be apparent from the results in Table 2, when the reduction ratio was lower than 40%, the tensile strength of the wire before the heat treatment for half annealing was lower than 27 kg·f/mm$^2$, thus failing to give a sufficient strength.

TEST EXAMPLES 10 TO 12

Silver (0.1% by weight) was added to oxygen free copper containing 8 ppm of oxygen and 0.006% by weight of unavoidable impurities, and the resulting copper alloy was drawn by a dip forming method to obtain a wire having a diameter of 16 mm. Then the wire was drawn to obtain a wire having a diameter of 1.27 mm, which was full annealed. Then the wire was drawn at a reduction ratio of no lower than 99.9% to obtain an fine wire having a diameter of 40 μm.

The fine wire was subjected to no heat treatment for half annealing (Test Example 10), subjected to heat treatment for half annealing at a temperature of 600° C. (Test Example 11) or subjected to heart treatment for half annealing at a temperature of 700° C. (Test Example 12) to prepare respective conductors.

These conductors were measured on their, tensile strength and elongation.

The results obtained are shown in Table 3 below.

TABLE 3

| Run No. | Diameter of Conductor (μm) | Tensile Strength (Kgf/mm²) | Elongation (%) |
|---|---|---|---|
| | (Test Examples 10 to 12) | | |
| 10 | 40 | 50.0 | 0.2 |
| 11 | 40 | 27.5 | 11 |
| 12 | 40 | 23.2 | 16.5 |

As will be apparent from the results in Table 3, the fine wire subjected to no heat treatment for half annealing showed hardening due to the drawing, resulting in that it had a decreased elongation and a poor flexibility. The fine wire subjected to heat treatment for half annealing revealed to have undergone excessive softening, thus failing to give sufficient tensile strength.

TEST EXAMPLE 13

The same conductor as obtained in Test Example 3 except that the diameter was changed to 30 ∝m was coated with a polyurethane coating material and baked to cover thereon a polyurethane insulation layer having a thickness of 4 μm to prepare an fine insulated wire.

The fine insulated wire was measured on the number of pin-holes in the insulation layer, dielectric breakdown voltage, tensile strength, elongation and solderability. The number of pin-holes was expressed in number per 5 m of enameled wire according to JIS-C-3003K. The solderability was judged to be good when the wire was wetted with solder at a solder temperature of 380° C. in 2 seconds.

The results obtained are shown in Table 4 below.

Table 4 (Test Example 13)

| | Test Example 13 |
|---|---|
| Number of pin-holes (No./5 m) | 0 |
| Dielectric breakdown voltage (V) | 2,900 |
| Tensile strength (kg.f/mm²) | 27.5 |
| Elongation (%) | 11 |
| Solderability | good |
| Resistance of conductor (Ω/m) | 23.25 |

EXAMPLE 1

A phenoxy resin coating material was coated on the fine insulated electric wire obtained in Test Example 13 (outer diameter: 38 μm) and baked to cover thereon an adhesive layer having a thickness of 1 μm. Two pieces of the thus obtained wire were arranged parallel to each other and passed through a heating furnace at about 200° C. in close contact with each other to melt the adhesive layer to bond the wires, thus preparing an fine double core parallel bonded wire.

Various characteristics of the fine double core parallel bonded wire are shown in Table 5 below.

TABLE 5

| | |
|---|---|
| (Example 1) | |
| Appearance | good |
| Final diameter (μm) | 40 × 81 |
| Separability of wires | 1 to 2 seconds |
| Dielectric breakdown voltage (V) | 3,000 |
| Solderability | good |
| Number of pin-holes after separation of wires (No./5 m) | 0 |

Figure 2:
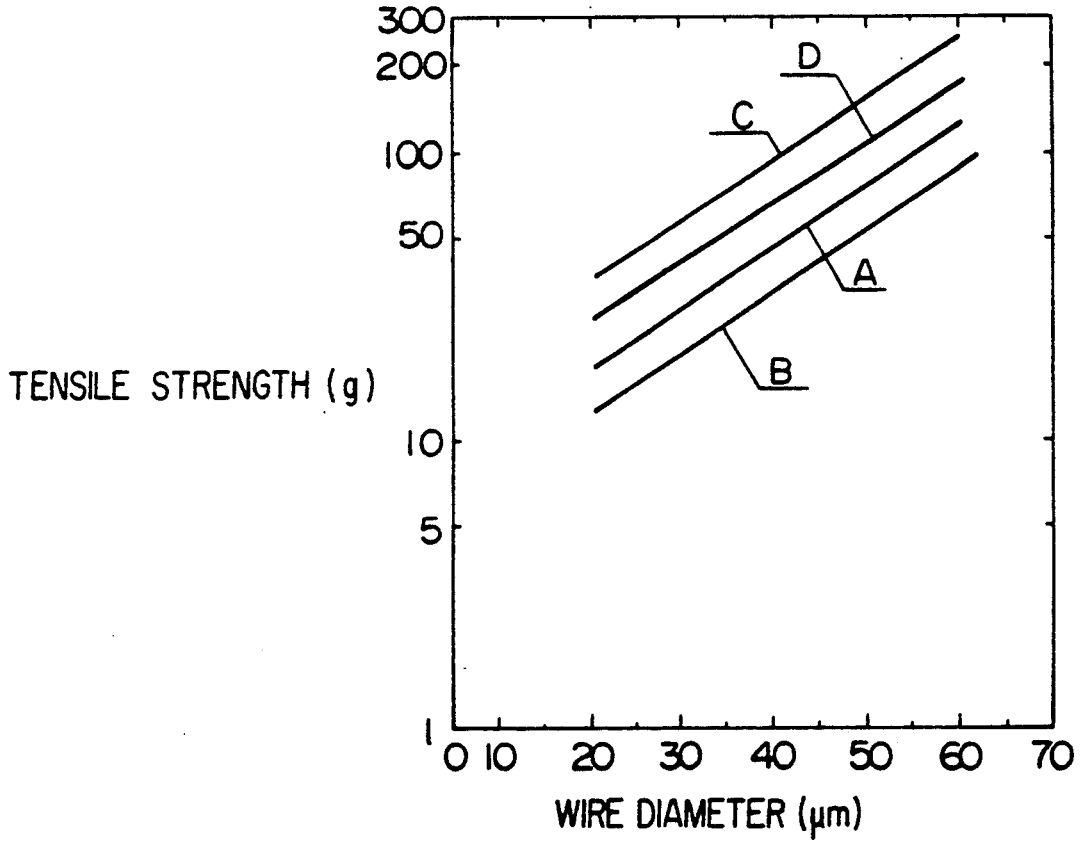
FIG. 2 is a graph representing the relationship between the wire diameter and elongation strength of the multiple core parallel bonded wire according to a specific embodiment of the present invention.

The graph illustrated in FIG. 2 represents relationship between the wire diameter and tensile strength for each of an enameled wire (A) containing 0.1% by weight of silver, an enameled wire (B) containing no silver, a double core parallel bonded wire (C) obtained from the enameled wire (A) and a double core parallel bonded wire (D) obtained from the enameled wire (B).

The graph clearly shows that the tensile strength of the wire was significantly improved by the addition of silver.

EXAMPLE 2

A copper alloy wire containing 0.01% by weight of Ag and having a diameter of 16 mm was drawn to obtain a wire stock having a diameter of 2.6 mm. Then, after fully annealing it in a furnace of an inert gas atmosphere, the stock wire was drawn at a reduction ratio of no lower than 99.9% to obtain an fine wire having a diameter of 40 μm. Thereafter, the fine wire was converted in a half-softened state by annealing it at a temperature of 400° C. in a transfer annealing furnace of an inert gas atmosphere to prepare an Ag containing-copper alloy fine wire having a tensile strength of 35 kg·f/mm² and an elongation of 5%.

EXAMPLE 3

The procedures of Example 2 were repeated except that the speed at which the wire was transferred was made slower to make longer retention time in the transfer annealing furnace, i.e., annealing time than that in Example 2 to prepare an Ag containing-copper alloy fine wire having a tensile strength of 27 kg·f/mm² and an elongation of 14.5%.

EXAMPLE 4

A copper alloy wire containing 0.1% by weight of Ag and having a diameter of 16 mm was drawn to obtain a wire stock having a diameter of 2.6 mm. Then, after fully annealing it in a furnace of an inert gas atmosphere, the stock wire was drawn to obtain an fine wire having a diameter of 52 μm. Further, after fully annealing it in a transfer annealing furnace of an inert gas atmosphere, the wire stock thus obtained was drawn at a reduction ratio of 40.8% to obtain an fine wire having a diameter of 40 μm. Thereafter, the fine wire was converted in a half softened state by annealing it at a temperature of 400° C. in a transfer annealing furnace of an inert gas atmosphere to prepare an Ag containing copper alloy fine wire having a tensile strength of 27.7 kg·f/mm² and an elongation of 11%.

COMPARATIVE EXAMPLE 1

The procedures of Example 2 were repeated except that the speed at which the wire was transferred was made slower to make longer retention time in the transfer annealing furnace, i.e., annealing time than that in Example 3 to prepare an Ag containing-copper alloy fine wire having a tensile strength of 23.2 kg·f/mm² and an elongation of 16.5%.

COMPARATIVE EXAMPLE 2

The procedures of Example 2 were repeated except that the temperature of the transfer annealing furnace was changed to 300° C. and the speed at which the wire was transferred was made slower to make longer retention time in the transfer annealing furnace, i.e., annealing time than that in Example 2 to prepare an Ag containing-copper alloy fine wire having a tensile strength of 41 kg·f/mm² and an elongation of 2.5%.

COMPARATIVE EXAMPLE 3

The procedures of Example 2 were repeated using the same annealing treatment and reduction ratio except that the starting material was changed to 99.99% by weight (four nine) oxygen free copper wire (diameter: 16 mm) and the temperature of the transfer annealing furnace was changed to 300° C. to prepare a pure copper fine wire having a tensile strength of 28 kg f/mm$^2$ and an elongation of 10%.

COMPARATIVE EXAMPLE 4

The procedures of Example 2 were repeated using the same full annealing treatment and reduction ratio except that the starting material was changed to 0.005% by weight Ag containing-copper alloy rod (diameter: 16 mm) and the temperature of the transfer annealing furnace was changed to 300° C. to prepare an Ag containing-copper alloy fine wire having a tensile strength of 32 kg·f/mm$^2$ and an elongation of 7%.

COMPARATIVE EXAMPLE 5

The same copper alloy wire as used in Example 4 was drawn to obtain a wire stock having a diameter of 2.6 mm. Then, after fully annealing it in a furnace of an inert gas atmosphere, the stock wire was drawn to obtain a wire having a diameter of 43 μm. Further, after fully annealing it in a transfer annealing furnace of an inert gas atmosphere, the wire thus obtained was drawn at a reduction ratio of 13.5% to obtain an Ag containing-copper alloy fine wire having a diameter of 40 μm and having mechanical characteristics of a tensile strength of 25 kg·f/mm$^2$ and an elongation of 18%.

The copper alloy fine wires (including copper fine wires) obtained in Examples 2 to 4 and Comparative Examples 1 to 5 were measured on their conductivity (% IACS). Then, after coating enamel on the periphery of the copper or copper alloy wire wires and baking, they were examined if they were softened. Furthermore, each of the resulting wire wires was wound around the ferrite core portion of a magnetic head and degree of easiness of winding was examined. The results obtained are shown in Table 6 below.

TABLE 6

| | Conductivity (% IACS) | Occurrence of softening in enameling step | Easiness of winding |
|---|---|---|---|
| Example 2 | 99 | No | Good |
| Example 3 | 100 | No | Good |
| Example 4 | 100 | No | Good |
| Comparative Example 1 | 100 | No | Difficult to wind because the wire tended to be bent. |
| Comparative Example 2 | 99 | No | Difficult to wind because the wire tended to cause spring-back. |
| Comparative Example 3 | 101 | Yes | Difficult to wind because the wire tended to be bent. |
| Comparative Example 4 | 100 | Yes | Difficult to wind because the wire tended to be bent. |
| Comparative Example 5 | 100 | No | Difficult to wind because the wire tended to be bent. |

From Table 6 above, it will be clear that the copper alloy fine wires having high conductivities as high as 99 to 100% IACS showed no softening after the baking of enamel and were wound easily.

On the other hand, the copper alloy or pure-copper fine wires obtained in Comparative Examples 1 to 15 had sufficiently high conductivities of 99 to 101% IACS. However, the copper alloy fine wire obtained in Comparative Example 1 in which the transfer annealing time was longer than Example 1 and that obtained in Comparative Example 5 in which the reduction ratio was as low as 13.5% did not show softening after the baking enamel but had insufficient tensile strengths in the winding step, resulting in that they had poor bending resistances and thus were difficult to be wound.

Also, the copper alloy fine wire obtained in Comparative Example 2 in which the transfer annealing time was shorter than Example 2 did not show softening after the baking enamel but caused spring-back because of insufficient elongation during he winding step, thus making it difficult to wind it. Furthermore, the pure copper fine wire containing no Ag obtained in Comparative Example 3 and the copper alloy fine wire with an Ag content of 0.005% by weight obtained in Comparative Example 4 suffered from softening due to the baking of enamel to decrease their tensile strengths, resulting in that their bending resistances were poor and therefore it was difficult to wind them.

What is claimed is:

1. A copper alloy wire having an outer diameter of no larger than 90 μm and of no less than 0.01% by weight of Ag and balance oxygen free Cu and unavoidable impurities, wherein said copper alloy wire has been prepared by drawing a wire stock having said composition at a reduction ratio of no lower than 40% and subjecting said wire stock to heat treatment for half annealing to have a tensile strength of 27 to 35 kg·f/mm$^2$ and an elongation of 5 to 15%.

2. A copper alloy wire as claimed in claim 1, wherein said copper alloy wire has an outer diameter of no larger than 40 μm.

3. An insulated electric wire having a copper alloy fine electric wire having a final diameter of no larger than 90 μm as a conductor and an insulation layer covering the conductor, wherein said copper alloy wire has a composition composed of no less than 0.01% by weight of Ag and balance oxygen free Cu and unavoidable impurities, and wherein said copper alloy wire has been prepared by drawing a wire stock having said composition at a reduction ratio of no lower than 40% and subjecting said wire stock to heat treatment for half annealing to have a tensile strength of 27 to 35 kg·f/mm$^2$ and an elongation of 5 to 15%.

4. An insulated electric wire as claimed in claim 3, wherein said insulation layer is composed of polyurethane.

5. An insulated electric wire as claimed in one of claims 3 and 4, further comprising an adhesive layer provided on said insulation layer.

6. A multiple core parallel bonded wire comprising two or more insulated electric wires bonded parallel to each other as cores, wherein said insulated electric wires each are an insulated electric wire having a copper alloy wire as a conductor and an insulation layer covering the conductor, wherein said copper alloy wire has a composition composed of no less than 0.01% by weight of Ag and balance oxygen free Cu and avoidable impurities, and wherein said copper alloy wire has been prepared by drawing a wire stock having said composition at a reduction ratio of no lower than 40% and subjecting said wire stock to heat treatment for half annealing to have a tensile strength of 27 to 35 kg·f/mm$^2$ and an elongation of 5 to 15%.

7. A multiple core parallel bonded wire as claimed in claim 6, further comprising a protective layer provided on said insulation layer.

8. A multiple core parallel bonded wire as claimed in one claims 6 and 7, wherein said two or more insulated wires are bonded to each other intermittently in a longitudinal direction.

* * * * *